US005148747A

United States Patent [19]

Rodi et al.

[11] Patent Number: 5,148,747

[45] Date of Patent: Sep. 22, 1992

[54] PROCESS FOR SETTING A PRODUCTION RUN INK ZONE PROFILE

[75] Inventors: Anton Rodi, Leimen; Bernd Müller, Nussloch; Robert Müller, Mörlenbach, all of Fed. Rep. of Germany

[73] Assignee: Heidelberger Druckmaschinen AG, Heidelberg, Fed. Rep. of Germany

[21] Appl. No.: 803,337

[22] Filed: Dec. 4, 1991

Related U.S. Application Data

[63] Continuation-in-part of Ser. No. 540,612, Jun. 19, 1990, Pat. No. 5,081,926.

[30] Foreign Application Priority Data

Jun. 19, 1989 [DE] Fed. Rep. of Germany ..... 3919922
Apr. 28, 1990 [DE] Fed. Rep. of Germany ..... 4013740
Aug. 28, 1991 [DE] Fed. Rep. of Germany ..... 4128537

[51] Int. Cl.[5] ..... B41F 7/04; B41F 7/26

[52] U.S. Cl. ..... 101/450.1; 101/137

[58] Field of Search ..... 101/450.1, 140, 136, 101/137, 141-148, 349-352, 492, 483, 211

[56] References Cited

U.S. PATENT DOCUMENTS 3,056,346 10/1962 Gammeter et al. ..... 101/144
3,771,446 11/1973 Kaneko et al. ..... 101/44
4,000,692 1/1977 Wirz et al. ..... 101/144
4,434,716 3/1984 Ishii et al. ..... 101/142
4,660,470 4/1987 Kramp et al. ..... 101/426

FOREIGN PATENT DOCUMENTS 1561100 2/1970 Fed. Rep. of Germany .
2202490 9/1988 United Kingdom .

*Primary Examiner*—J. Reed Fisher
*Attorney, Agent, or Firm*—Nils H. Ljungman and Associates

[57] ABSTRACT

A process for setting a production run ink zone profile on an offset printing press. Initially, an ink zone profile is established which is the reverse of the desired ink zone profile, and, thereafter, this reverse ink profile is switched over to the ink profile actually desired.

20 Claims, 11 Drawing Sheets

PROCESS FOR SETTING A PRODUCTION RUN INK ZONE PROFILE

CROSS-REFERENCE TO RELATED APPLICATIONS

The present application is a continuation-in-part of U.S. patent application Ser. No. 07/540,612, filed on Jun. 19, 1990, now U.S. Pat. No. 5,081,926, by Anton Rodi and entitled "Method and Apparatus for the Rapid Establishment of an Ink Zone Profile in an Offset Printing Press".

BACKGROUND OF THE INVENTION

1. Field of the Invention

The present invention relates to a process for setting a production run ink zone profile on an offset printing press, the offset printing press including an inking mechanism, a wetting mechanism and an ink dosing apparatus for setting an ink profile, and wherein the applicator rolls of the inking and wetting mechanism are either continuously or temporarily in contact with the printing form.

2. Background Information

On offset printing presses, it is often necessary for a thin ink film of ink to be fed to the printing plate (or "printing form"), which is commonly wetted with a wetting agent. For the purpose of supplying the thin ink film, the offset printing press is normally provided an inking mechanism equipped with a number of rollers. Supply of the wetting agent is accomplished via a wetting mechanism, which is also normally equipped with one or more rollers. Depending upon the subject matter of the printing plate (i.e., depending upon the image to be printed), an appropriate ink distribution (i.e., an ink zone profile) is established in a direction transverse to the printing direction of the offset printing press, in order to achieve a good printing result. Therefore, the inking mechanism is preferably provided with zonewise adjustable ink dosing apparatus, which makes possible the establishment of a zonally appropriate transverse ink zone profile. Such an "ink dosing apparatus" is well known in the art and is described, for example, in U.S. Pat. No. 5,010,820 entitled "Process for the Defined Production of an Ink Distribution Appropriate to Production Run in the Inking Unit of Rotary Printing Presses," U.S. Pat. No. 3,978,788 issued on Sep. 7, 1976, and U.S. Pat. No. 3,908,545 issued on Sep. 30, 1975. The setting of the individual ink zones results in a correspondingly appropriate ink layer thickness (i.e., a zonally adjusted ink film thickness) being produced in the inking mechanism which supplies ink to the printing plate. The ink is fed by means of a ink ductor (normally via an ink ductor roller) from an ink pan (or ink reservoir). The task of the printing press operator is to make the required zonal adjustments of the ink dosing apparatus as a function of the inking requirements of the image impressed upon the printing plate. Before the printing itself takes place, a so-called ink introduction step (or ink zone setup) is conducted, in which the above-mentioned zonally profiled ink film is built up inside the inking mechanism. In the prior art, prior to the date of application of the parent application referenced above, movable applicator rollers assumed a position separated from the printing plate during this ink introduction step, so that no inking of the printing plate took place during the ink introduction period.

In addition to the ink being distributed in the circumferential direction by the rotating motion of the inking mechanism applicator rollers, the ink is often additionally distributed laterally by a traverse reciprocating motion of provided distributing rollers during the ink introduction step. In addition to the known advantages of such lateral distribution, normally carried out without the applicator rolls being in contact, the transverse ink zone profile produced by the ink dosing apparatus during the ink introduction step is once again evened out to a certain extent in the transverse or lateral direction, so that when printing begins, the ink profile is not exactly as specified. The problems described above also exist when a so-called "jam" occurs, i.e., a short interruption of the printing process, and also during a pause in the printing run to wash the blanket cylinder of the offset printing press, since, when the printing process is restarted, there will initially be a somewhat unsatisfactory ink profile. To eliminate this disadvantage, the above-noted parent application introduced the idea that the rotating applicator rollers of the inking and wetting mechanisms should be maintained in contact with the printing form. This results in the subject matter of the printing plate (that is, the impression or image formed thereon) assisting the ink distribution, so that an ink zone profile corresponding as closely as possible to the image on the printing plate is achieved. The zonally adjusted ink profile introduced via the ink dosing apparatus is re-established by the back-and-forth movement of the applicator rollers and the printing form. As a result of this inventive measure disclosed in the above-noted parent application, the number of waste sheets previously required in the prior art can be significantly reduced. Therefore, an ink profile which closely corresponds to that required for a production run is quickly achieved.

With the process disclosed in the above-noted parent application, it has been discovered by the present inventor that, when the applicator rollers are in contact with the printing plate, and when the ink dosing apparatus is set for a desired production run ink profile, the ink introduction step may cause an ink distribution in the inking mechanism which deviates from the desired ink profile. That is, there may be a higher or lower (or both) maximum or minimum thickness of the zonal profiled ink layer. In particular, this "generalizing" occurs with subject matters (i.e., referring to the particular printing image carried on the printing plate) which have sharply contrasting zonal ink layer thicknesses. To limit this effect in such extreme cases, the printing press operator previously manually fed ink into the zones involved, normally by means of a spatula or trowel, so as to be able to at least start the printing process and not have serious problems in the production process. In such a case, however, the ink-water equilibrium may be significantly disrupted in portions of the image not carrying any ink.

OBJECT OF THE INVENTION

One object of the present invention is, therefore, the provision of a method and apparatus for the achievement of an ink profile corresponding to that required for the production run as quickly as possible, and for reducing the number of waste sheets produced.

SUMMARY OF THE INVENTION

This and other objects are achieved in accordance with the invention, in that the quantitative ink feed is controlled in the first step so that it generates a production run ink zone profile which is reversed in relation to the desired production run ink zone profile, (i.e., the ink zone profile is oversized or undersized), and that, in the second step, the quantitative ink feed is controlled so that it corresponds to the actual desired production run ink zone profile.

The present invention takes advantage of the generalization of the ink profile described above. Surprisingly, it has been discovered that adequate production run status is achieved significantly more rapidly, and without additional waste sheets, if, first, a reverse setting of the ink dosing apparatus is established, which is then adjusted to the optimal production run status during the ink introduction step. Moreover, an optimal equilibrium between ink and wetting agent is achieved for the production run. In the overall inking mechanism, an ink gradient corresponding to reality is built up, without having to use the conventional run of waste sheets. That is, actual printing can be started without having to run a number of preliminary sheets (i.e., waste sheets) through the printing press. This process for the rapid achievement of the optimal production run status can be performed at the beginning of printing, after interrupting the printing process (e.g., when starting over again at the beginning of the day), after washing the rubber mat or when changing printing jobs.

In one preferred embodiment of the invention, the quantitative ink feed in the second step is conducted so that it is simultaneously adapted to the desired zonal production run profile, independently of the difference between the reverse ink profile and the desired production run ink profile.

Since, in the vicinity of the extreme values of the reverse ink profile and of the actual desired ink profile, the duration of the setting of the ink dosing elements is greater than in the vicinity of the turning points (that is, the average presetting of all of the zones of a printing unit), there is preferably provided a control which compensates for differences over time, so that the most rapid possible adjustment to the optimal status is achieved.

Moreover, in accordance with one aspect of the invention, during the ink introduction step, the quantity of wetting agent is reduced in relation to the quantity fed during the production run.

In further accordance with another aspect of the invention, the inking mechanism control is preferably controlled in coordination with the ink dosing apparatus (that is, in coordination with the applicator rollers and the intermediate rollers), so that optimal production run conditions are achieved In yet an additional embodiment of the invention, the setting of the reverse ink profile is made by means of an electronic computer control apparatus. For example, the optimal production run ink profile is determined by means of a plate scanner which determines the surface coverages for each zone, and then the appropriate reverse ink profile is determined by means of this data, and the ink dosing apparatus is set accordingly. The production run profile can also be preset by means of a light pen or keyboard, and then executed by the computer apparatus in accordance with this aspect of the invention.

The advantages achieved by the invention relate in particular to the fact that an optimal production run status is achieved as rapidly as possible, with the use of only negligible amounts of waste sheets. On account of the use of the reverse ink profile, an ideal ink-water equilibrium is achieved. Smearing and emulsification are prevented. In particular, the production process is optimally suited for large printing jobs.

One aspect of the invention resides broadly in a method for establishing a production ink zone profile in an offset printing press, the printing press being for the production of successive prints of an image provided on a printing plate, the successive prints of the image being formed by the deposition of an ink on a printing medium during a printing operation of the offset printing press, the production ink zone profile being established in the printing press prior to the execution of the printing operation of the offset printing press, the printing press including a plate cylinder for receiving the mounting thereon of the printing plate, an ink reservoir for supplying the ink, an ink roller train comprising at least one ink applicator roller for transferring at least a portion of the ink supplied by the reservoir to the printing plate mounted on the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, the ink metering apparatus comprising a plurality of individually adjustable ink metering devices for supplying ink to the ink roller train, the plurality of individually adjustable ink metering devices being disposed sequentially across the printing press in a direction substantially transverse to the direction of travel of the printing medium through the printing press, each of the plurality of individually adjustable ink metering devices defining a corresponding ink zone of the printing press, the amount of ink metered into the corresponding sequentially disposed ink zones defining the ink zone profile of the printing press, the method comprising the steps of: determining, based upon the image provided on the printing plate, a production ink zone profile appropriate for the printing of the image provided on the printing plate during a production printing run; determining, for each of the plurality of individually adjustable ink metering devices, a production ink zone flow to produce the production ink zone profile in the printing press during the production printing; determining an ink flow level within the range of the determined production ink zone flows; inverting the production ink zone flows about the determined ink flow level to thereby produce an inverted ink zone flow such that at least one peak of the production ink zone flow becomes a trough of the inverted ink zone flow and at least one trough of the production ink zone flow becomes a peak of the inverted ink zone flow; thereafter, operating the printing press with the plurality of ink metering devices set to produce the inverted ink zone flow; thereafter, operating the printing press with the plurality of ink metering devices set to produce the production zone ink flow; and printing the image provided on the printing plate onto the printing medium.

Another aspect of the invention resides broadly in a method for establishing a production ink zone profile in an offset printing press, the printing press being for the production of successive prints of an image provided on a printing plate, the successive prints of the image being formed by the deposition of an ink on a printing medium during a printing operation of the offset printing press, the production ink zone profile being established in the printing press prior to the execution of the printing operation of the offset printing press, the printing press including a plate cylinder for receiving the mounting thereon of the printing plate, an ink reservoir for supplying the ink, an ink roller train comprising at least one ink applicator roller for transferring at least a portion of the ink supplied by the reservoir to the printing plate mounted on the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, the ink metering apparatus comprising a plurality of individually adjustable ink metering devices for supplying ink to the ink roller train, the plurality of individually adjustable ink metering devices being disposed sequentially across the printing press in a direction substantially transverse to the direction of travel of the printing medium through the printing press, each of the plurality of individually adjustable ink metering devices defining a corresponding ink zone of the printing press, the amount of ink metered into the corresponding sequentially disposed ink zones defining the ink zone profile of the printing press, the method comprising the steps of: determining, based upon the image provided on the printing plate, a production ink zone flow from each of the plurality of individually adjustable ink metering devices which produces a production ink zone profile appropriate for the printing of the image provided on the printing plate onto the printing medium; determining an average production ink zone flow, the average production ink zone flow being the substantial arithmetic average of the production ink zone flows for each of the plurality of individually adjustable ink metering devices; setting the plurality of individually adjustable ink metering devices to produce initial inverted ink zone flows, the initial inverted ink zone flows being a mirror image of the production ink zone flows, the mirror image being reflected about the average production ink zone flow; operating the printing press with the plurality of individually adjustable ink metering devices set to produce the initial inverted ink zone flows, and with the at least one ink applicator roller and the at least one wetting agent applicator roller in contact with the printing plate; setting the plurality of individually adjustable ink metering devices to produce the production ink zone flows; operating the printing press with the plurality of individually adjustable ink metering devices set to produce the production ink zone flows, and with the at least one ink applicator roller and the at least one wetting agent applicator roller in contact with the printing plate; and printing the image provided on the printing plate onto the printing medium.

Yet another further aspect of the invention resides broadly in a method for establishing a production ink zone profile in an offset printing press, the printing press being for the production of successive prints of an image provided on a printing plate, the successive prints of the image being formed by the deposition of an ink on a printing medium during a printing operation of the offset printing press, the production ink zone profile being established in the printing press prior to the execution of the printing operation of the offset printing press, the printing press including a plate cylinder for receiving the mounting thereon of the printing plate, an ink reservoir for supplying the ink, an ink roller train comprising at least one ink applicator roller for transferring at least a portion of the ink supplied by the reservoir to the printing plate mounted on the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, the ink metering apparatus comprising a plurality of individually adjustable ink metering devices for supplying ink to the ink roller train, said plurality of individually adjustable ink metering devices being disposed sequentially across the printing press in a direction substantially transverse to the direction of travel of the printing medium through the printing press, each of the plurality of individually adjustable ink metering devices defining a corresponding ink zone of the printing press, the amount of ink metered into the corresponding sequentially disposed ink zones defining the ink zone profile of the printing press, the method comprising the steps of: determining an appropriate ink zone profile for the printing of the image provided on the printing plate; determining, for each of the plurality of ink zones, an appropriate flow of ink from the corresponding ink metering device to produce the appropriate ink zone profile for the image provided on the printing plate; determining an average ink flow of the appropriate flows of ink; determining, for at least one of the ink zones, a corresponding signed difference between the corresponding appropriate ink zone flow and the average ink flow; initially, setting the corresponding at least one ink metering device to an initial flow setting which differs from the average ink flow by the corresponding difference multiplied by $-1$; thereafter, operating the printing press with the at least one ink metering device set to the initial flow setting; thereafter, setting the corresponding at least one ink metering device to the appropriate ink zone flow; thereafter, operating the printing press with the at least one ink metering device set to the appropriate ink zone flow; and thereafter, printing the image provided on the printing plate onto the printing medium.

BRIEF DESCRIPTION OF THE DRAWINGS

The invention is explained in greater detail below, with reference to the accompanying figures, wherein.

DESCRIPTION OF THE PREFERRED EMBODIMENTS

Figure 1:
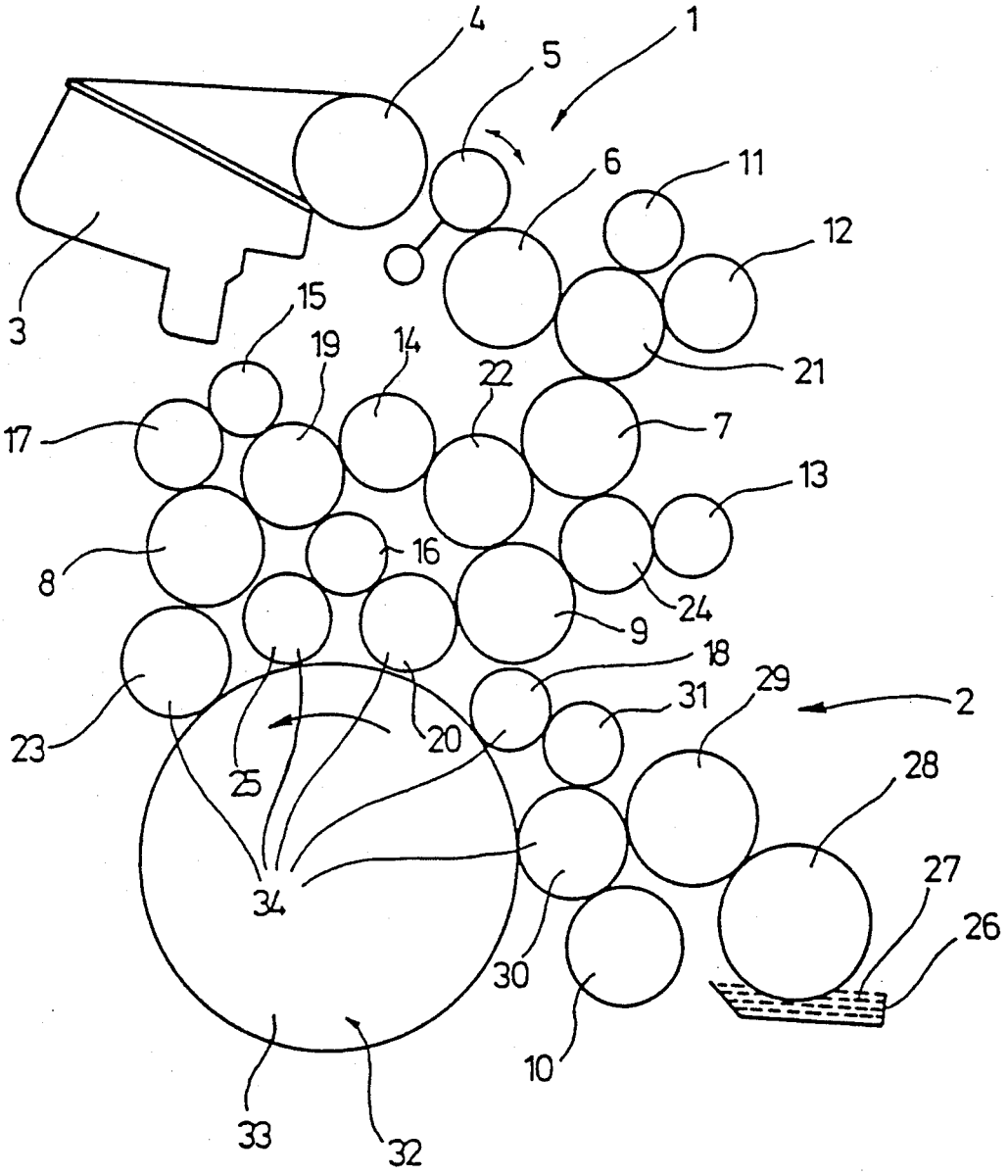
FIG. 1 is a schematic diagram of the rollers of an offset printing press, with the applicable rollers of an inking unit and a wetting unit moved into a position where they are in contact with a printing cylinder.

FIG. 1 is a schematic illustration of an offset printing press having an inking unit 1 and a wetting unit 2. The inking unit 1 has an ink pan or ("ink reservoir") 3 with an ink metering device, from which an ink ductor extracts measured amounts of ink during operation. A fountain roller 5 interacts with an ink ductor roller 4 and with a driven distributing cylinder 6. The inking unit 1 and the wetting unit 2 also have additional, preferably driven, distributing cylinders 7, 8, 9, 10. There are also six rollers and transfer rollers 11 to 16 and two rubber rollers 17 and 18. The inking unit 1 also has two rubber rollers 19 and 20, and three additional, larger-diameter rubber rollers 21 to 23. There are also two rubber rollers 24 and 25 which have diameters which are smaller than those of the rubber rollers 19 and 20.

The wetting unit 1 has a reservoir 26, which is filled with a wetting agent, and in which a portion of the circumference of a wetting fountain roller 28 is immersed. The wetting fountain roller 28 interacts with a wetting agent metering roller 29. There is also provided a rubber roller 30 and an intermediate roller 31.

By means of the arrangement of rollers described above, both ink and the wetting agent are transported to a printing forme 32. The printing forme 32 is configured as a plate cylinder 33, on the circumference of which there is clamped a printing plate having an image thereon, well known in the art and therefore not described in any further detail.

Figure 2A:
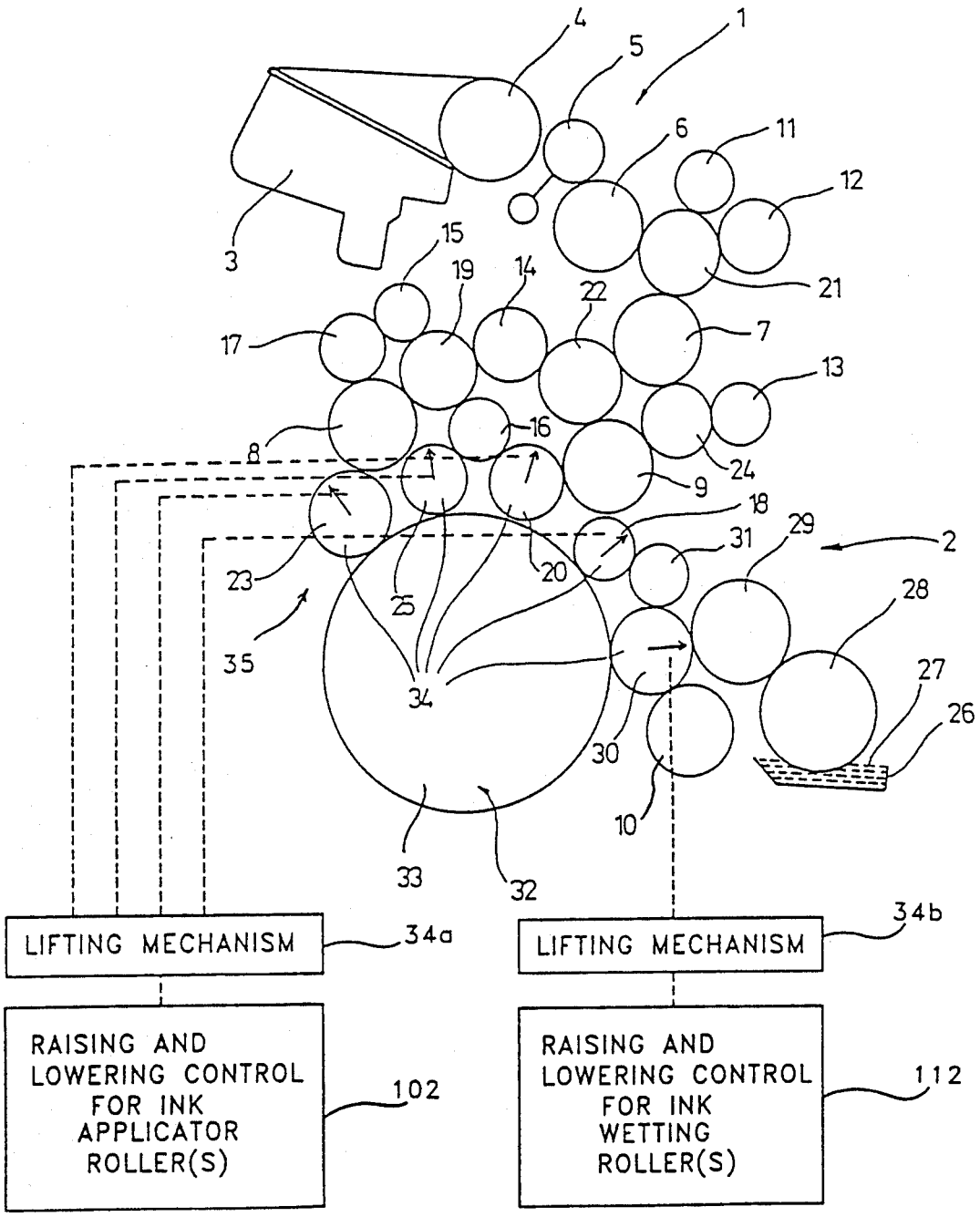
FIG. 2*a* is a schematic diagram, similar to FIG. 2, with a lifting mechanism shown.
Figure 2:
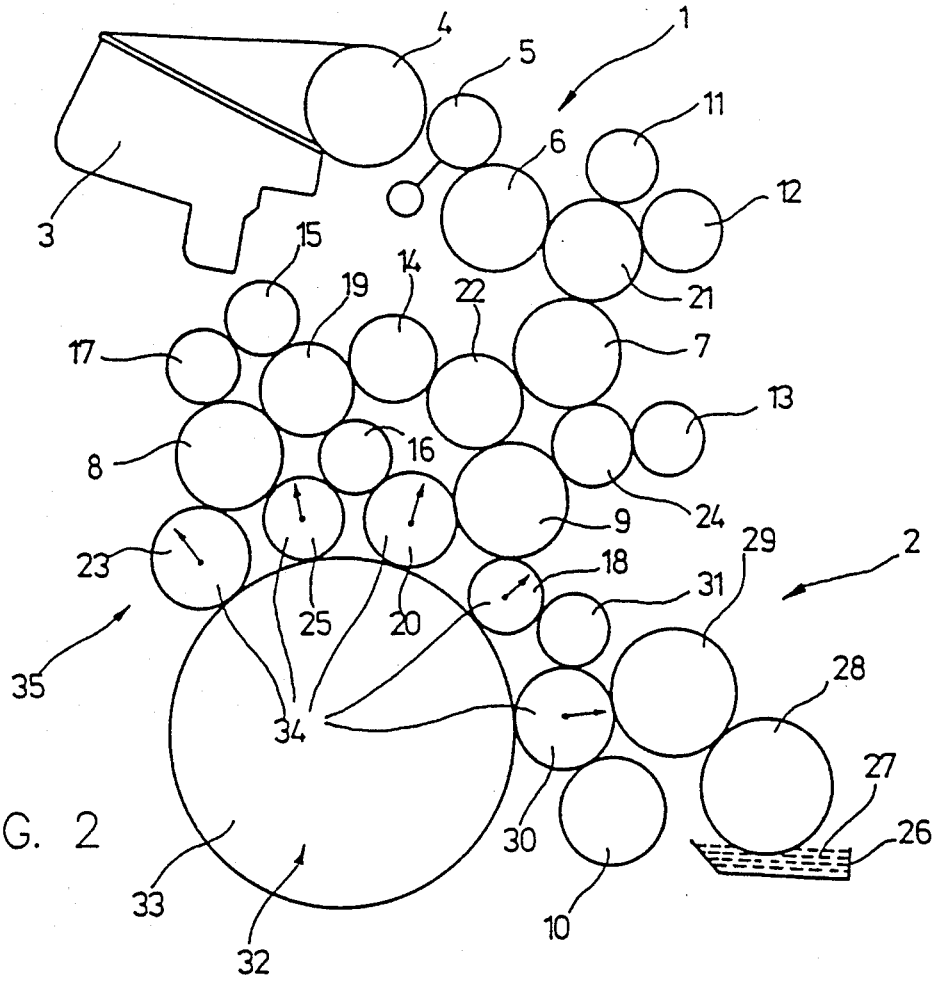
FIG. 2 is a schematic diagram, similar to the arrangement illustrated in FIG. 1, indicating however one possibility for moving the applicator rollers into noncontacting positions.

As shown in FIGS. 1 and 2, the transfer of ink and wetting agent to the printing plate (or printing forme 32) from the inking unit 1 and the wetting unit 2, respectively, is accomplished by the rubber rollers 18, 20, 23, 25 and 30, which are, therefore, also designated as applicator rollers 34.

The offset printing press is further provided with a control apparatus 35 (shown more fully in FIG. 2*a*), which makes possible the movement of the applicator rollers 34 towards and away from the printing forme 32.

In FIG. 2*a*, lifting mechanisms 34*a* and 34*b* are shown which lift the rollers 18, 20, 25, 23, and the roller 30, respectively. Raising and lowering controls 102 and 112 control the operation of the lifting mechanisms 34*a* and 34*b*, respectively, according to the various embodiments of the invention described herein.

Mechanisms which can affect, selectively, a relative separation or a relative contacting between a pair of rollers or a set of rollers are well known in the art and are therefore not described in detail herein. For example, Published German Patent Application No. 15 61 100, discussed above, discloses an inking unit for rotary printing presses having a controllable lifting mechanism for separating particular groups of rollers. In particular, there is disclosed a mechanism for the separation of a group of ink applicator rollers from a plate cylinder. Moreover, as discussed hereafter, U.S. Pat. No. 3,869,983, issued to Garber and entitled "Variable Repeat-Length Web Press", discloses an apparatus for moving one roller toward and away from a second roller.

Figure 3:
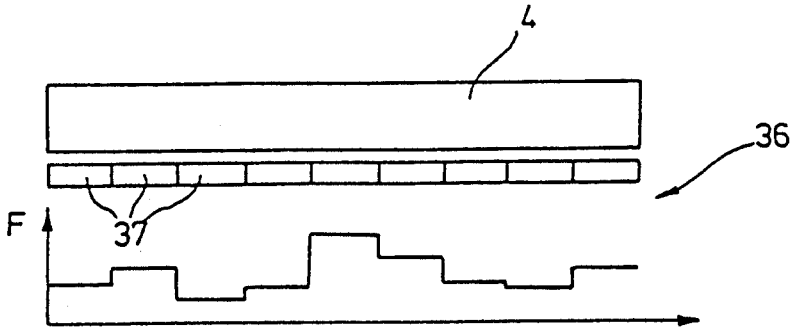
FIG. 3 is a schematic diagram of an ink metering apparatus, as well as a schematic diagram of an ink profile generated thereby.

Returning to the present invention, adjacent the ink pan 3 there is provided an ink metering apparatus 36, which is schematically illustrated in FIG. 3. The ink metering apparatus 36 makes possible, over the length of the ink ductor 4, a zonal adjustment of the lateral ink profile, e.g., like the one illustrated in the diagram in FIG. 3. In each zone 37, the quantity of ink delivered (e.g., the ink layer thickness F) can be set so that it is appropriate for the inking requirements of the image on the printing plate (or printing forme 32).

By means of the control apparatus 35, the applicator rollers can be moved into the contacting position illustrated in FIG. 1, wherein the applicator rollers 34 of the inking unit 1 and of the wetting unit 2 are in contact with the printing plate (or printing form 32) clamped on the plate cylinder 33. In FIG. 2, the arrows corresponding to the applicator rollers 34 indicate that a shift can be made by means of the control apparatus 35, so that there is a separation between the applicator rollers 34 and the convex surface of the plate cylinder 33, and therefore, the surface of the printing plate clamped thereon.

According to the invention, before the beginning of printing, and in particular during the admission of the ink or during an interruption of the printing run, in particular during jams and/or blanket washing processes, the applicator rollers 34 remain in the contact position with the plate cylinder 33, as shown in FIG. 1. This generates an ink profile close to that required for the printing run. This has the advantage that when the printing is begun or resumed, the desired ink profile corresponding to the image can be achieved in the shortest possible time, so that optimal, essentially waste-free printing results can be achieved. The contact position can also be assumed by the applicator rollers 34 only temporarily, that is, during only a portion of the admission of the ink or of an interruption in the printing process.

WORKING EXAMPLES

Figure 4:
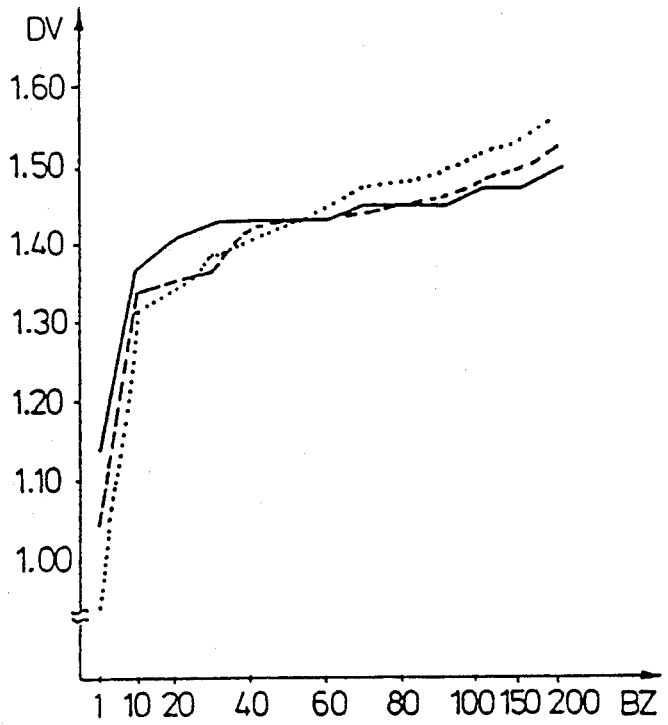
FIG. 4 is a plot illustrating the average full tone density established after the start of printing.
Figure 5:
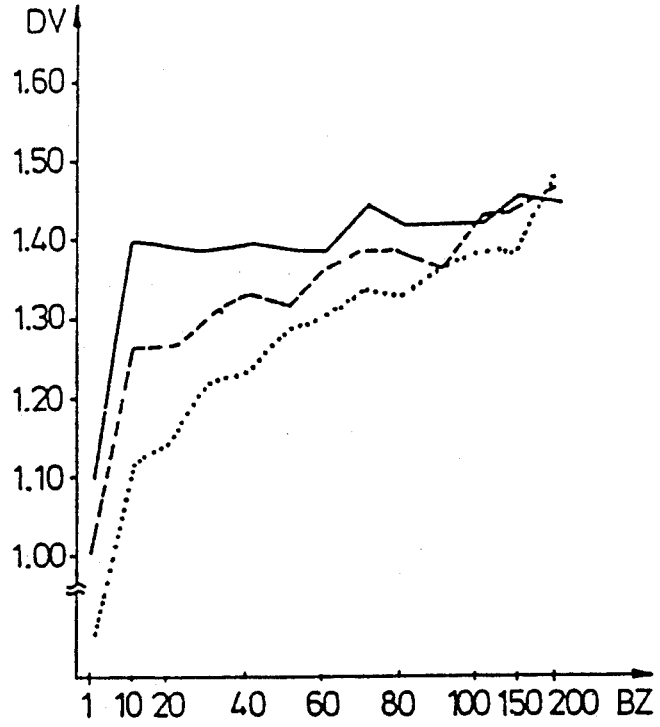
FIG. 5 is a plot, like FIG. 4, showing a zone of the ink metering apparatus with a high ink feed.
Figure 6:
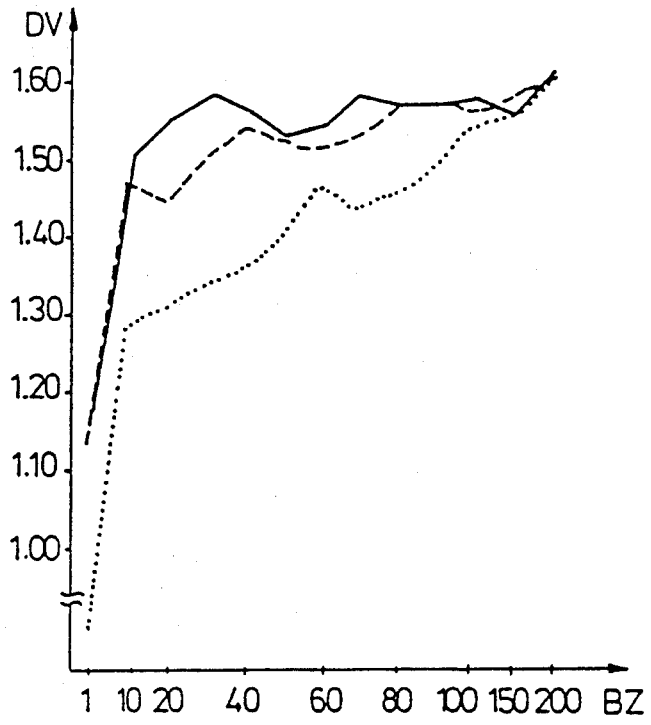
FIG. 6 is a plot, as in FIG. 5, of a zone with a low ink feed.

By way of example, FIGS. 4, 5 and 6 are plots derived from ink admission (or ink profile establishment) tests, in which the full tone density DV is plotted on the ordinate and the number of sheets produced after the beginning of printing (the sheet count: BZ) is plotted on the abscissa. The solid-line curves set forth in FIGS. 4 to 6 show the full tone density DV when the ink profile has been set, and when an ink admission period lasting 6 minutes has been conducted. According to the invention, during the ink admission, the applicator rollers 34 shown in FIG. 1 are in their contacting position to produce the results shown by the solid-line curves. This contact can be continuous, i.e., it can last for the entire duration of the ink admission period, or the contact can be temporary, i.e., lasting only a portion of the ink admission period. Additionally, depending on the current conditions, different periods of contact are also conceivable. The contact position can also be continued for only a determined number of machine revolutions. During this admission time or period of contact, the quantity of wetting agent delivered is increased as follows: beginning: 33.3%, then 55.5%, the final 2 minutes 88.8% and finally (i.e., during the printing run) 100%.

In contrast, the dashed curves set forth in FIGS. 4 to 6, show the full tone density DV produced according to processes of the prior art, i.e., 6 minutes of ink admission and an adjustment of the ink metering apparatus 36 according to the printing run profile. Moreover, according to the processes known in the prior art, and shown by the dashed curves in FIGS. 4 to 6, the applicator rollers 34 are moved into the position where they are in contact with the plate cylinder 33 only at the beginning of printing. Additionally, the amount of wetting agent fed is 100%.

Finally, the dotted curves in FIGS. 4 to 6 also show the full tone density DV according to other known processes of the prior art, that is, with an ink admission time of 6 minutes, the ink profile is initially uniform over the entire printing width, and the printing run profile is established only after 6 minutes have passed.

In FIG. 4, the average value of the full tone density DV is shown as measured over all zones 37. It is apparent that by means of the process according to the invention, the curve quickly approaches a final value after a relatively few sheets, for example 40, while, with the process of the prior art, the final value is reached only after a significantly greater number of sheets. In the range of 100 to 200 sheets, all 3 curves still exhibit an ascending tendency of the full tone density DV, but the curve ascent of the process according to the invention is the smallest of the three.

The diagram in FIG. 5 shows the full tone density DV of a certain zone 37, which, on account of the image, requires a relatively large amount of ink. While, with the processes of the prior art, the full tone density DV increases only slowly after the beginning of printing, with the process according to the invention, it reaches the final value after relatively few impressions.

The diagram in FIG. 6 shows the full tone density DV of a zone 37 which requires only a small amount of ink. Here too, it is apparent that the final value of the full tone density DV corresponding to the printing run status is achieved with the process according to the invention significantly earlier than is the case with the processes of the prior art.

Figure 7:
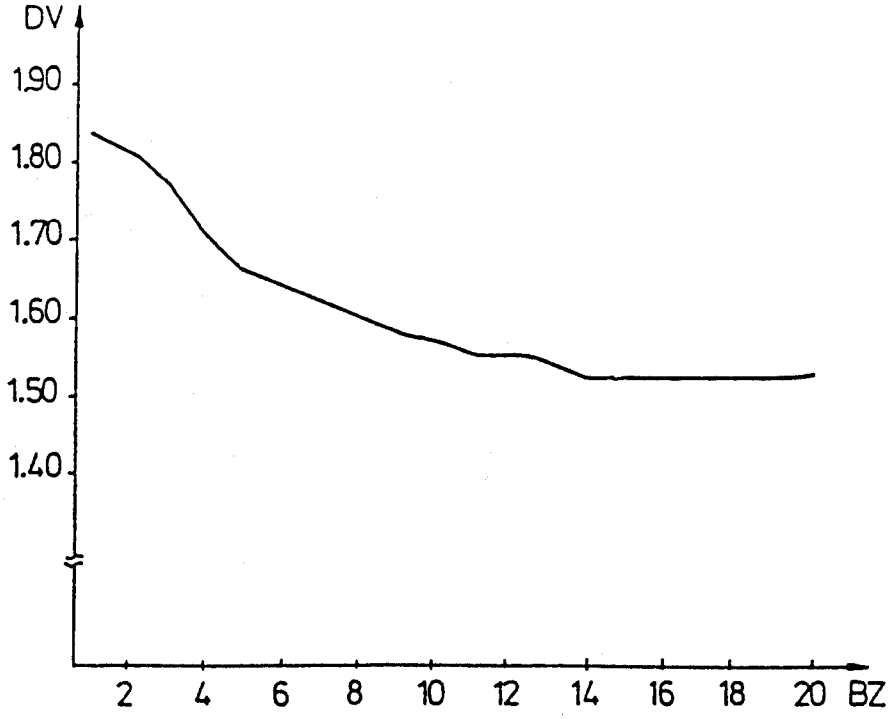
FIG. 7 is a plot of the full tone density following a paper jam.

The diagram in FIG. 7 shows the curve of the full tone density DV as a function of the number of sheets BZ on the occasion of a paper jam, i.e., an interruption of the printing run. During the jam, the rotating applicator rollers 34, in accordance with the invention, remain in contact with the rotating plate cylinder 33. The interruption lasts 6 minutes, and during that time, the wetting agent feed is increased from 44.4% to 55.5% and finally to 66.6%. During the start-up phase, it is 66.6%, and finally reaches 100% in the printing run condition. It is apparent that the full tone density DV is quickly approaching the final value required for the printing run process after approximately 14 sheets.

Figure 8:
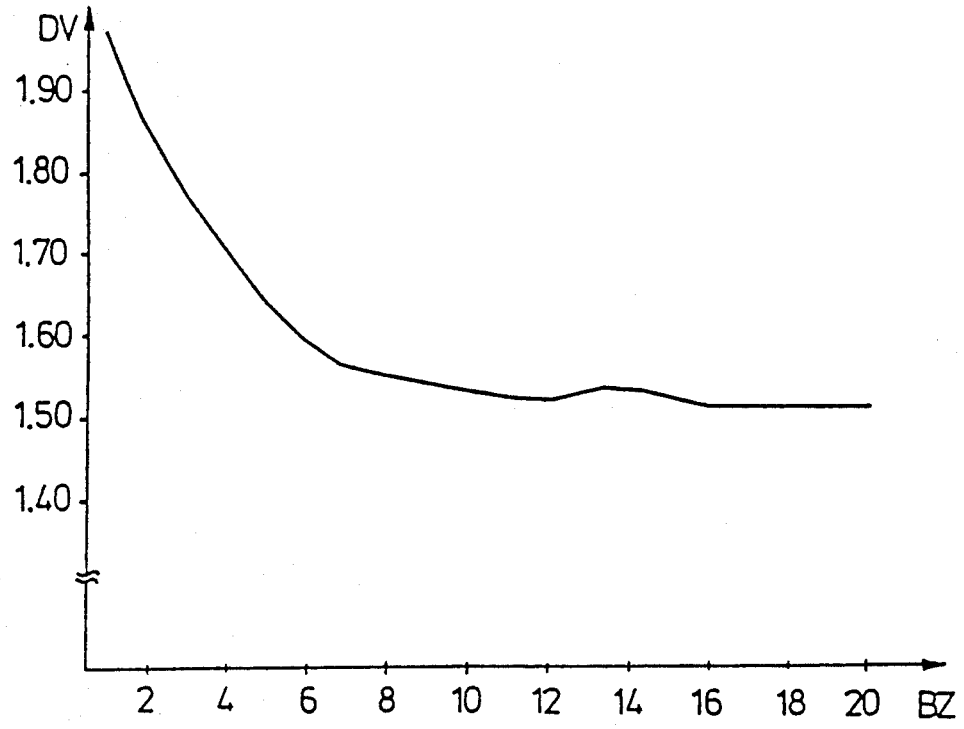
FIG. 8 is a plot, as in FIG. 7, following a stoppage in the feeding of paper to be printed.
Figure 9:
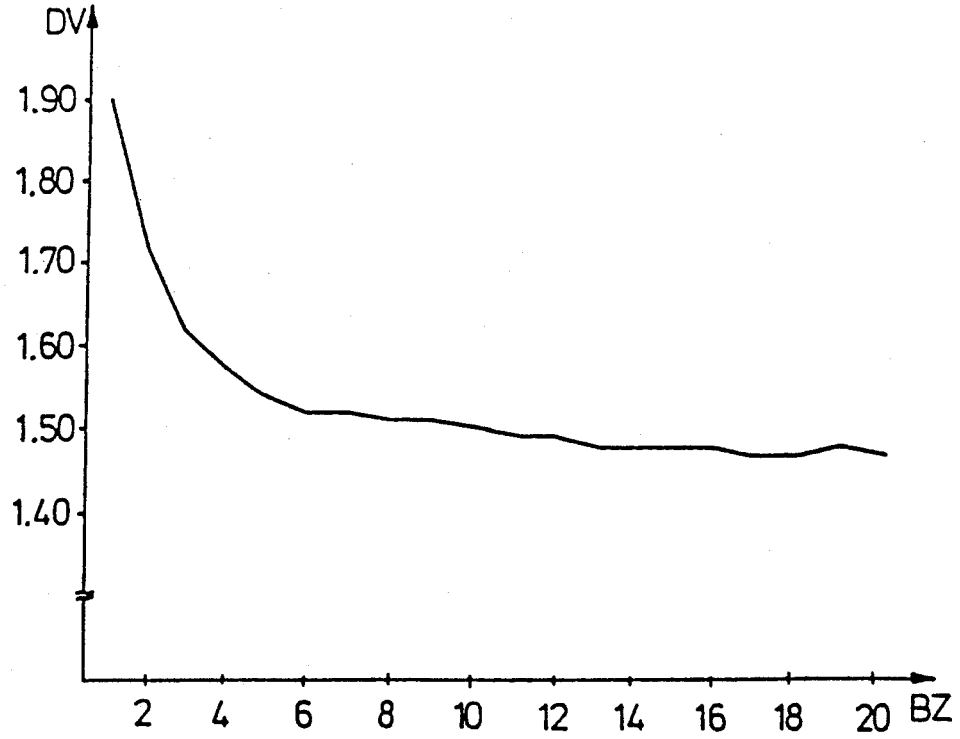
FIG. 9 is a plot, as in FIG. 8, with an excess wetting process.

FIGS. 8 and 9 show the curve of the full tone density DV following a paper feed jam, i.e., an interruption of the printing run. In both cases, during the jam, the applicator rollers 34, in accordance with the invention, remain in contact with the plate cylinder 33. In the test illustrated in FIG. 8, the start-up occurs after 16 revolutions. This is also true for the test illustrated in FIG. 9, but here, shortly before the start-up, an excess wetting is performed. In both cases, the required full tone density DV is achieved after approximately 15 sheets following the resumption of printing operations.

FIGS. 4–9 illustrate impressively that, by means of an offset printing press method and/or apparatus according to the invention, an ink profile close to that required for the printing run can be achieved in an extremely short period of time, so that as little paper as possible is wasted.

Figure 12:
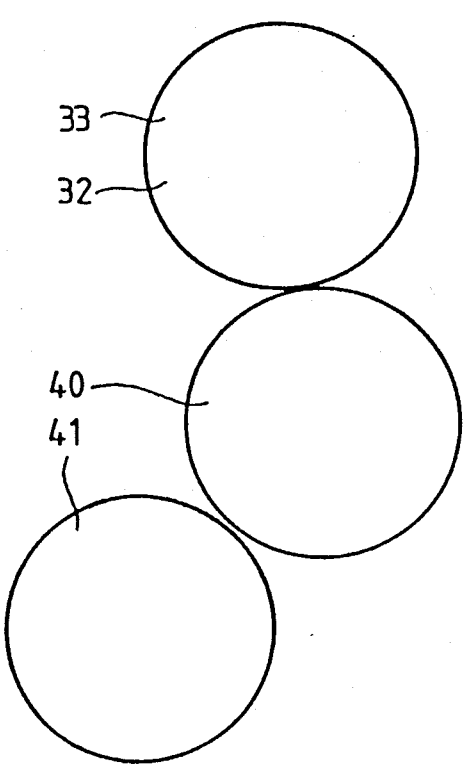
FIG. 12 is a schematic diagram, as in FIG. 11, but with the offset printing press in the printing run position.
Figure 11:
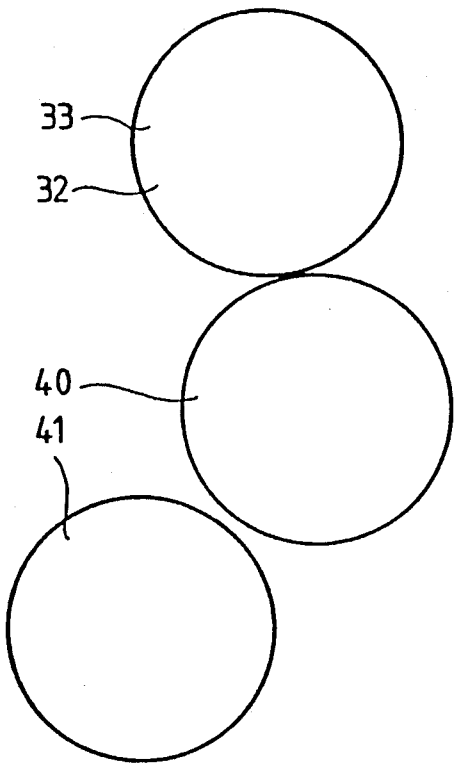
FIG. 11 is a schematic diagram, as in FIG. 10, but during the inking of the blanket.

In addition to the measures described above, simultaneously with or subsequent to the inking of the printing forme 32, the blanket of a blanket cylinder 40 can also be inked. This aspect of the invention is schematically illustrated in FIGS. 10 to 12.

Figure 10:
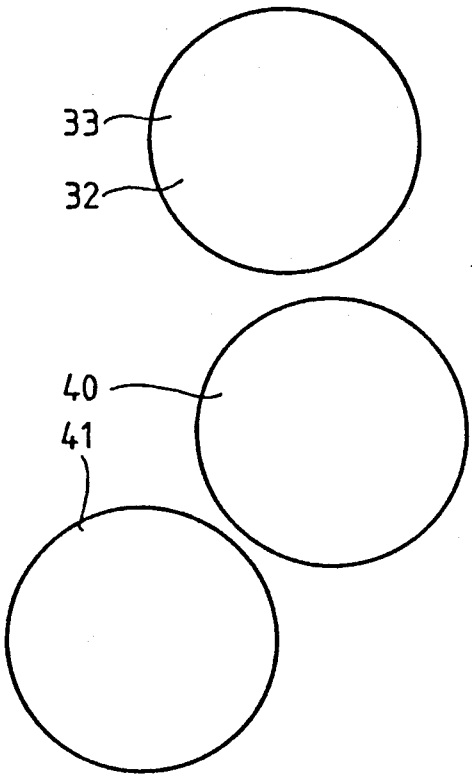
FIG. 10 is a schematic diagram showing the arrangement of a plate cylinder, a blanket cylinder and a printing cylinder, before the inking of a rubber blanket of the blanket cylinder.

FIG. 10 shows the plate cylinder 33, as well as a blanket cylinder 40 and a printing cylinder 41 of an offset printing press. In FIG. 10, these cylinders are shown in their positions before the beginning of printing. The plate cylinder 33 and the blanket cylinder 40 are spaced at some distance from one another. The blanket cylinder 40 and printing cylinder 41 are also spaced at a slight distance from one another. The distance between the blanket cylinder 40 and the printing cylinder 41 is coordinated with the thickness of the material to be printed (e.g. paper). The adjustment to the printing material thickness is done by means of a so-called "print feed adjustment". Print feed adjustment mechanisms for adjusting the distance between a blanket cylinder and a printing cylinder are well known in the prior art and are, therefore, not described in detail herein. For example, U.S. Pat. No. 3,869,983, issued to Garber and entitled "Variable Repeat-Length Web Press" discloses an apparatus for moving an impression roller toward and away from a printing roller. The print feed adjustment preferably has an electrical adjustment mechanism for the positioning according to the thickness of the material to be printed. To be able to ink the blanket of the blanket cylinder 40 simultaneously with or subsequent to the inking of the printing forme 32, the position in FIG. 11 is assumed. This is a quasi-operating position, but the printing operation is not initiated, and in contrast to the normal printing run position, the blanket cylinder 40 assumes a position in which it is separated from the printing cylinder 41. However, the printing forme 32 and the blanket cylinder 40 are in contact with one another, so that the inking of the blanket can be carried out. The separation between the blanket cylinder 40 and the printing cylinder 41 is preferably accomplished by means of the above-mentioned print feed adjustment.

As mentioned above, the print feed adjustment is moved by means of the electrical adjustment out of its customary working range for a paper thickness adjustment, so that there is no contact between the blanket cylinder 40 and the printing cylinder 41. This also represents a new use of the print feed adjustment mechanisms known in the prior art. The inking of the blanket takes place during a few revolutions of the corresponding cylinder. Once this has occurred, the transition to the actual printing position can be made. In other words, the printing run position in FIG. 12 is assumed, wherein the plate cylinder 33 is in contact with the blanket cylinder 40, and where there is a relatively small separation (not readily visible in FIG. 12) corresponding to the paper thickness adjustment between the blanket cylinder 40 and the printing cylinder 41.

Figure 13:
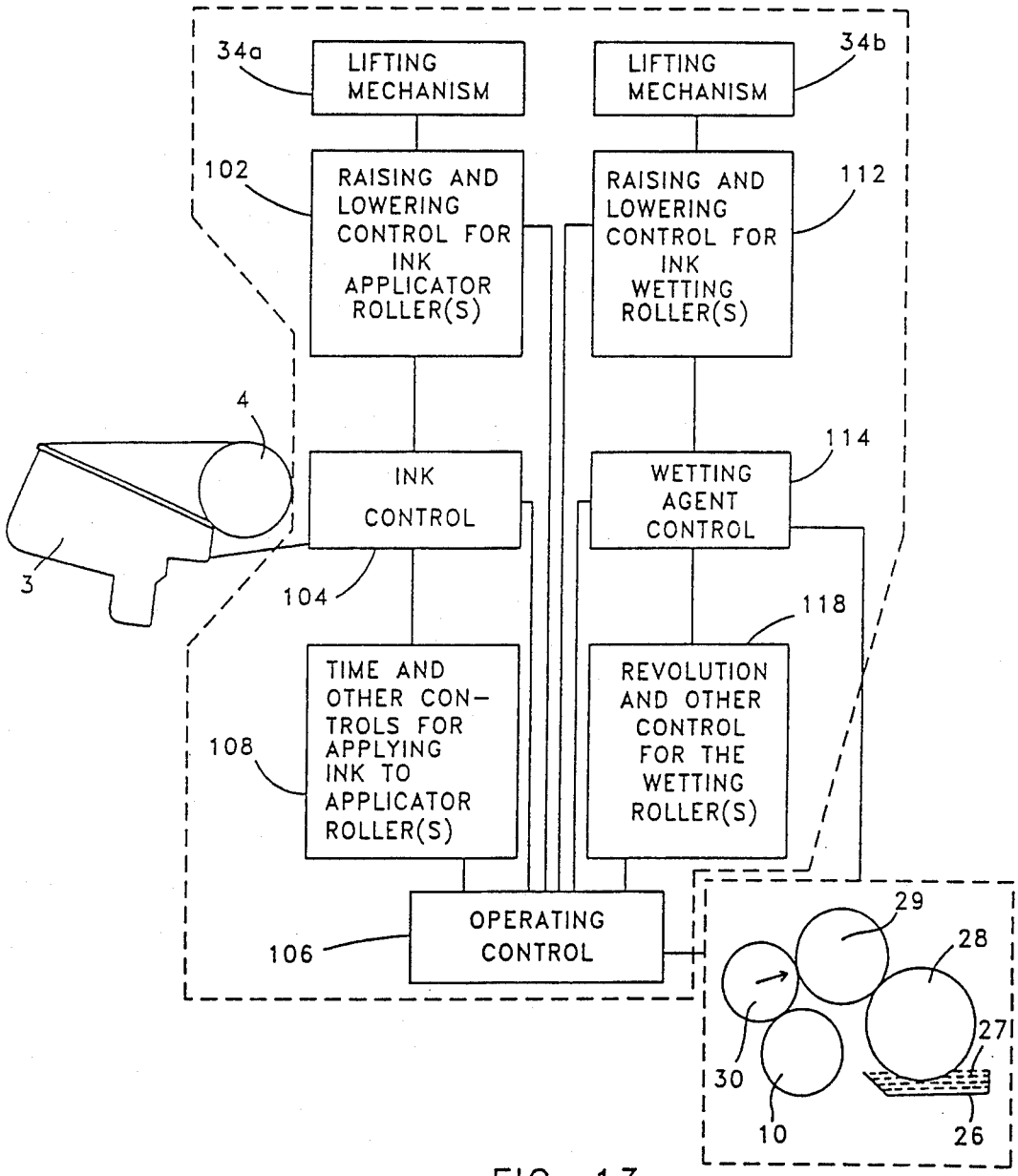
FIG. 13 shows the control system for the printing press.

Now referring to FIG. 13, a control circuit is shown, together with its component control functions and circuitry in block diagram form. Connected to the lifting mechanism 34*a* is a raising and lowering control 102 for the ink applicator rollers. An ink control 104 is provided which receives signals from the raising and lowering control 102 for the ink applicators and also from an overall operating control 106. Signals are also provided to the ink control 104 from a control circuitry 108 which controls the times and other controls for applying ink to the applicator rollers. The ink control 104 controls the ink pan 3 and the ink ductor 4. The lifting mechanism 34*b* is connected to an analogous raising and lowering control 112 for the wetting rollers. This raising and lowering control 112 for the wetting rollers is connected to the overall operating control 106 and also to a wetting agent control 114. The wetting agent control 114 controls the distributing cylinder 10, the rubber roller 30, the metering roller 29, and the fountain roller 28, which are part of the printing press. Connected to the wetting agent control 114 is a control circuitry 118 which controls the revolutions and other controls for the wetting agent rollers. Just as the overall operating control 106 is similarly connected to the control circuitry 108, the overall operating control 106 is connected to the control circuitry 118. The operating control 106 is also connected to and receives signals from the printing press.

Control systems for controlling various aspects of the operation of an offset printing press, such as, for example, the timings and quantity of various fluid flows, the speed of rotation of various rollers and the timing and degree of separation between specific rollers in such printing presses are well known. For example, the publication entitled "Heidelberg CPC", published by Heidelberger Druckmaschinen AG, D-6900 Heidelberg (Publication No. HN2/43.e) describes such a control system for effecting these various functions and is well known in the art. One aspect of the control system described in this Heidelberg Publication is disclosed in German Published Patent Application No. 37 06 695 discussed above.

Still further, Heidelberg Publication HN1/48.e published by Heidelberger Druckmaschinen AG, D-6900 Heidelberg describes another such control system referred to in the art as the "CPTronic" system, which utilizes fully digitized technology for press control monitoring and diagnoses.

Figure 14:
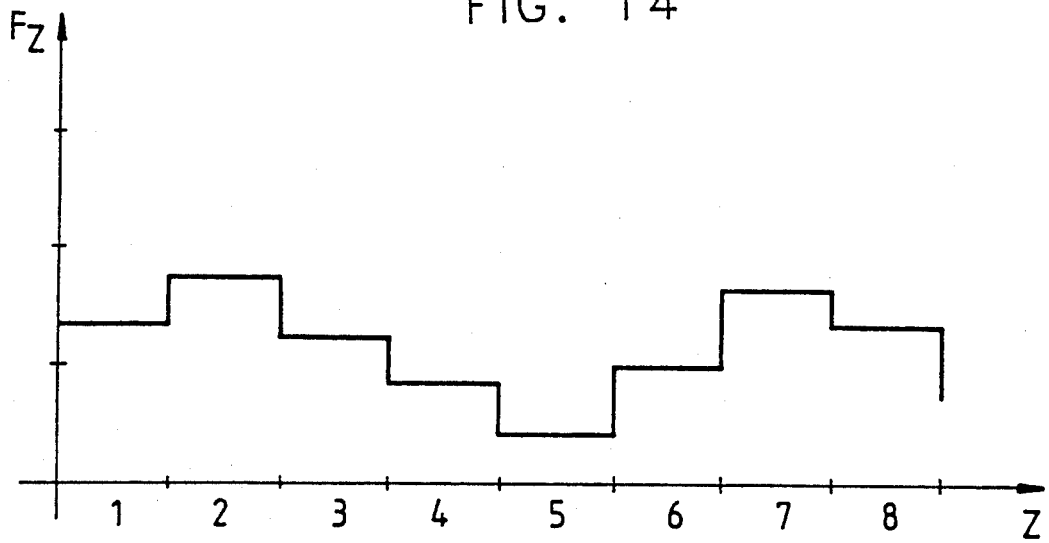
FIG. 14 is a schematic diagram of zonally adjusted ink zone profile produced by the ink dosing apparatus of an offset printing press.

FIG. 14 shows a diagram in which the ink coating thickness for each of the zones Z of the ink dosing apparatus $F_Z$ is plotted against the zones Z. There is shown a profile of the ink layer thickness, whereby the ink stripe width set by the ink ductor roller was kept constant (e.g., at 50%). The ink quantity or flow $V_F$, which is plotted in FIG. 15 as the solid line curve over the zones Z, corresponds approximately to this profile. The ink quantity $V_F$ is proportional to the product of the ink ductor stroke $F_D$ and the ink zone aperture $F_Z$. The curve corresponds to the desired quantity of ink for the production run status. The curve, for example, has two maxima and one minimum. A horizontal line which corresponds to the average ink consumption over all of the ink zones of the printing unit runs through the turning points between the extremes. If, however, the applicator rollers are in contact with the printing plate (for example, in accordance with the process disclosed in the above-noted parent application), and the ink dosing apparatus were to be set according to the solid curve (corresponding to the production run process) for the zonal ink quantity, there would be initially an overdosing or an underdosing, as described above. Such overdosing and/or underdosing is illustrated schematically by the dotted curve in FIG. 15. The present invention takes advantage of this effect, thereby achieving a surprisingly positive result. First, the ink dosing apparatus (i.e. the ink feed to the zones Z) is set so that a reverse quantitative ink distribution is achieved, as illustrated by the dashed curve in FIG. 15, and then this setting is modified so that the broken-line curve is fitted to the curve represented by the solid line (i.e., to the optimal production run status). In this manner an optimal ink-water equilibrium is achieved. The approximation (or fitting) of the reverse curve to the desired curve is indicated by arrows in FIG. 15.

Figure 16:
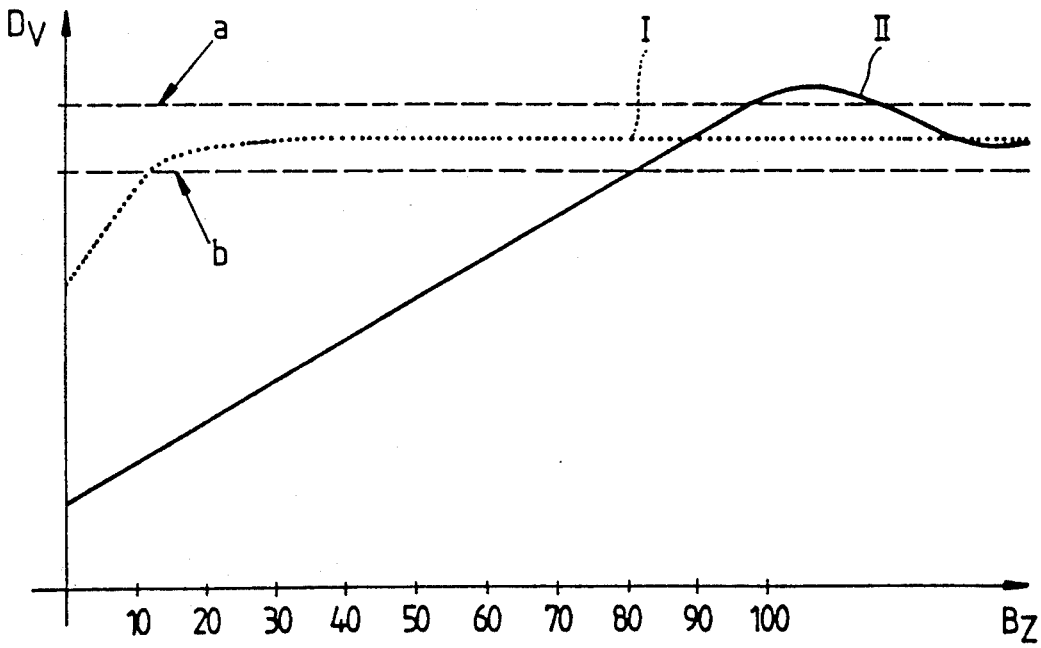
FIG. 16 is a diagram of the ink layer thickness during the ink introduction step.

FIG. 16 shows the average value of the full tone density DV as a function of the sheet number BZ. The horizontal curves a and b show the waste sheets for overinking and underinking, respectively. The setting is optimal when it is between the horizontal lines a and b, as shown in Curve I. It is clearly apparent that with the process according to the invention, the dotted Curve I tends toward the final value after a relatively few sheets, while, on the other hand, the solid Curve II, which corresponds to the setting of the ink layer density without the reverse control setting according to the present invention, achieves a comparably optimal condition only at a later time. Thus, the numbers of waste sheets which have to be printed (approximately 100–300) using the processes of the prior art are no longer necessary, and the production process can be started after a very small number of waste sheets (approximately 10 to 50 sheets).

In other words, the present invention utilizes, to good effect, the phenomenon described above, wherein, when the applicator rollers of the inking and wetting mechanisms are maintained in contact with the plate cylinder during the so-called ink introduction period (as disclosed in the above-noted parent application), there is a tendency toward an overshoot or undershoot, respectively, in the areas of maximum and minimum ink thickness. This phenomenon is generally most apparent when the production printing run involves an image having areas requiring substantially differing thicknesses (or flows) of ink, for example, an image having one area requiring relatively dense ink coverage and another area requiring relatively sparse ink coverage.

Referring again to FIG. 15, the ink flow $V_F$ which is determined to be appropriate for a particular image provided on a printing plate is there shown by a solid line. Such appropriate ink zone flows may be derived from the use of a printing plate image reader such as the one described in the publication entitled "Heidelberg CPC", published by Heidelberger Druckmaschinen AG, D-6900 Heidelberg (Publication No. 4,681,455 entitled "Method of Determining the Area of Coverage of a Printed Original or a Printing Plate for Printing Presses", equivalent to published European Patent Appln. No. 0 095 606 AZ.

Figure 15:
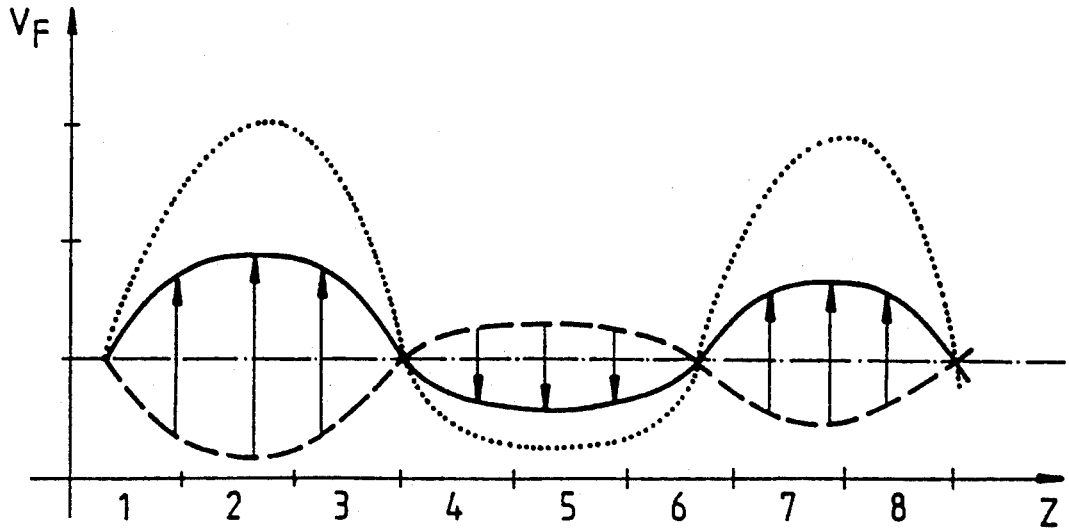
FIG. 15 is a schematic diagram showing the quantities of ink introduced during an ink introduction step and during a production run.

However, due to the above-noted "generalizing" effect, the actual achieved flows may overshoot (or undershoot) the derived appropriate flows in the areas of maximum (or minimum) flow, as shown by the dotted line in FIG. 15, particularly when the method of the parent application (i.e., the method for maintaining the inking and wetting applicator rollers in contact with the plate cylinder during the ink introduction period) is adopted. The present invention is directed to the reduction and/or elimination of this overshoot/undershoot phenomenon.

Referring still to FIG. 15, it will be seen that the determined appropriate ink zone flows generally form a graphical production (or appropriate) flow line (i.e., the solid line depicted in FIG. 15) across the ink zones $Z=1, 2 \ldots 8$. This production ink zone flow line has at least one area of maximum flow (i.e., a peak) and at least one area of minimum flow (i.e., a valley or trough). In general, the present invention is directed to first determining an intermediate ink flow level, the intermediate ink flow level being within the range defined by the maximum and minimum production ink zone flows determined as being appropriate for the particular image provided on the printing plate. In the preferred embodiment illustrated in FIG. 2, the intermediate ink flow level chosen is the arithmetic average of all of the determined appropriate ink zone flows for the ink zones $Z=1, 2 \ldots 8$. However, it is believed that intermediate ink flows other than the arithmetic average may be appropriate.

Next, the production ink zone flow line is inverted about the chosen intermediate ink flow level, to thereby produce an inverted ink zone flow line, such that peaks of the production ink zone flow line become troughs of the inverted ink zone line, and such that troughs of the production ink zone flow line become peaks of the inverted ink zone flow line. Alternatively, this may be viewed as forming a reflected mirror image of the production ink zone flow line about the chosen intermediate ink flow level to form the inverted ink zone flow line. Still further, a similar effect can be achieved by determining, for each ink zone $Z=1, 2 \ldots 8$, a signed difference (i.e., +or −times a scalar value) between the production ink zone flow and the chosen intermediate ink zone flow, multiplying each signed difference by −1, and adding the results to the chosen intermediate ink flow to produce the inverted ink zone flows.

Figure 17:
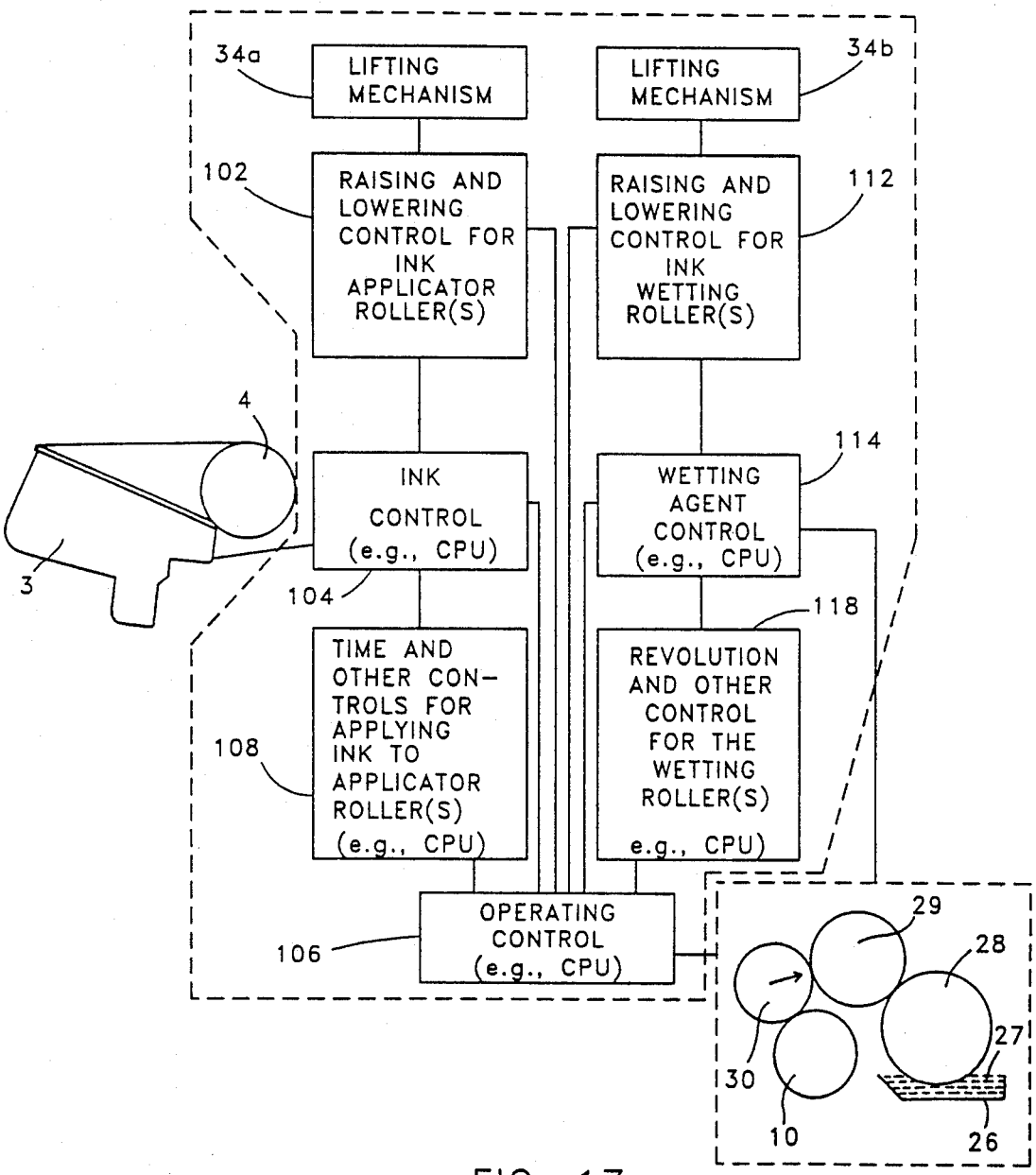
FIG. 17 is a schematic diagram of a control system for an offset printing press, similar to FIG. 13, but showing the possible use of a programmable CPU device for controlling certain aspects of the process, as described more fully below.

FIG. 17 is similar to FIG. 13, but additionally shows various aspects of the disclosed process which, in a particularly preferred embodiment thereof, are controlled by a programmable CPU device, for example, a microprocessor. As discussed above, the particular ink zone profile (and/or ink flow $V_F$) which is appropriate for a particular image provided on a printing plate may be determined using a printing plate image reader such as the one described in the publication entitled "Heidelberg CPC" referenced above. Typically, such a printing plate image reader will employ a programmable CPU device. The same, or a similar, CPU device may also be used for controlling some (or nearly all) of the steps described above of determining, based upon the image provided on the printing plate, a production ink zone profile appropriate for the printing of the image provided on the printing plate during the production printing run; determining, for each of the plurality of individually adjustable ink metering devices, a production ink zone flow to produce the production ink zone profile in the printing press during the production printing; determining an ink flow level within the range of the determined production ink zone flows; and inverting the production ink zone flows about the determined ink flow level to thereby produce an inverted ink zone flows, such that peaks of the production ink zone flow become troughs of the inverted ink zone flows, and such that troughs of the production ink zone flow become peaks of the inverted ink zone flows.

In particular, such a programmable CPU device is particularly well adapted for performing at least one of the steps of determining an ink flow level within the range of the determined production ink zone flows and inverting the production ink zone flows about the determined ink flow level to thereby produce inverted ink zone flows, such that peaks of the production ink zone flows become troughs of the inverted ink zone flows, and such that troughs of the production ink zone flows become peaks of the inverted ink zone flows.

German Published Patent Application No. 37 06 695 discloses a process for the generation of a defined ink distribution in the inking unit of rotary printing machines which is close to the ink profile required for the printing run, and in which, before the beginning of printing, first the ink profile present in the inking unit from the preceding printing job is removed, while the unit is rotating, by closing the ink metering elements and by the return feed into the ink reservoir of the amounts of ink present in the inking unit as a function of the profile, so that a basically constant thickness ink layer remains, the thickness of which is independent of the profile. Then, the ink profile required for the subsequent printing Job is generated in the inking unit by a zonal adjustment of the ink metering elements with a defined number of revolutions of the inking unit rollers.

Published German Patent Application No. 33 38 143 discloses a presetting of the inking unit. To generate a defined distribution of the ink in the inking unit which is close to that required for the printing run, a precisely measured quantity of ink is transported to the inking unit rollers before the beginning of printing by means of the vibrator rollers, so that a pre-determined distribution of ink layer thicknesses is established upon the rollers of the inking unit.

Published German Patent Application No. 15 61 100 discloses an inking unit for rotary printing presses which has controllable lifting means, to separate defined groups of rollers. These lifting means also move the applicator rollers which interact with the printing forme. When there is an interruption of the printing, the lifting means bring about a separation of certain groups of rollers, and also shut off the applicator rollers.

In summary, one feature of the invention resides broadly in an offset printing machine with a wetting unit and an inking unit which has an ink metering device to adjust an ink profile, whereby the inking unit and the wetting unit each have at least one applicator roller which can be moved into a position where it is in contact with a printing forme, wherein the applicator rollers 34 for the generation of an ink profile close to that required for the printing run are moved by a control apparatus 35 into a position where they are permanently or temporarily in contact with the printing forme 32 during the admission of the ink which precedes the beginning of printing, or during a jam or blanket washing process which interrupts the printing run.

Another feature of the invention resides broadly in an offset printing machine wherein the control apparatus 35, during the admission of the ink, during the jam or during the blanket washing process, reduces the amount of wetting agent delivered from the amount delivered during the printing run.

Yet another feature of the invention resides broadly in an offset printing machine wherein the control apparatus 35 adjusts the speed of rotation of a fountain roller 28 of the wetting unit 2.

A further feature of the invention resides broadly in an offset printing machine, wherein simultaneous with or subsequent to the inking of the printing forme 32 by the contact between the applicator rollers 34 and the printing forme 32, the blanket of a blanket cylinder 0 is also inked.

A yet further feature of the invention resides broadly in an offset printing machine, wherein the inking of the blanket is performed by the assumption of a contact position between the printing forme 32 and the blanket of the blanket cylinder 40.

Yet another further feature of the invention resides broadly in an offset printing machine, wherein a printing cylinder 41 assumes a position where it is separated from the blanket of the blanket cylinder 40 during the inking of the blanket.

An additional feature of the invention resides broadly in an offset printing machine, wherein to ink the blanket, the offset printing machine assumes its printing operating position, in which a print feed adjustment acting between the blanket cylinder 40 and printing cylinder 41 is moved out of its operating range in the printing run position, so that the blanket of the blanket cylinder 40 and the printing cylinder 41 can assume a position where they are separated from one another.

A yet additional feature of the invention resides broadly in an offset printing machine, wherein the printing forme 32 is a plate cylinder 33 with a printing plate clamped to its convex surface.

A further additional feature of the invention resides broadly in a process for the generation of an ink distribution close to that required for the printing run in the inking unit of an offset printing machine with an ink metering device to set an ink profile, and with applicator rollers of the inking unit and of a wetting unit which can be moved into a position where they are in contact with a printing forme, in particular for the operation of an offset printing machine, wherein the applicator rollers 34 are moved into the contact position during the admission of the ink which takes place before the beginning of printing, or during a jam or blanket washing process which interrupts the printing run.

A yet further additional feature of the invention resides broadly in a process wherein during the admission of the ink, during a jam or blanket washing process, the amount of wetting agent delivered is reduced from the amount delivered during the printing run.

Another further additional feature of the invention resides broadly in a process, wherein simultaneous with or subsequent to the inking of the printing forme 32 by the contact between the applicator rollers 3 and the printing forme 32, an inking of the blanket occurs by the assumption of a contact position between the printing forme 32 and the blanket of a blanket cylinder 40, whereby a printing cylinder 41 is moved into a position where it is separated from the blanket cylinder 40, in particular by means of a print feed adjustment.

A yet another additional feature of the invention resides broadly in an offset printing machine, wherein the separation of the blanket cylinder 40 and the printing cylinder 41 is performed or reached or maintained or during several revolutions of the blanket cylinder 40.

Another yet further feature of the invention resides broadly in a process wherein the ink metering device is automatically adjusted to achieve the optimal printing run conditions in coordination with the wetting unit control and the applicator rollers 34 by means of an ink control device, as a function of the current operating conditions.

A still further feature of the invention resides broadly in the use of a print feed adjustment acting between a blanket cylinder 40 and a printing cylinder 41 of an offset printing machine, to bring about a separation between the blanket cylinder 40 and the printing cylinder 41 during the inking of the blanket of the blanket cylinder 40 which occurs before the beginning of printing with the printing forme 32.

In summary, one feature of the invention resides broadly in a Process for setting a production run ink profile on an offset printing press having a wetting and inking mechanism which has an ink dosing apparatus to set an ink profile, whereby the applicator rollers of the inking and wetting mechanism are permanently or temporarily in contact with the printing form, as disclosed by the above-noted parent application, characterized by the fact that in the first step, the quantitative ink feed is controlled so that it produces an ink profile which is reverse, i.e. in opposite phase, to the desired production run ink profile, and that in the second step, the quantitative ink feed is controlled so that it corresponds to the desired production run ink profile.

Another feature of the invention resides broadly in a process as described immediately above, characterized by the fact that the quantitative ink feed in the second step is conducted so that it is simultaneously adapted by zones to the desired production run ink profile, independently of the difference between the reverse ink profile and the desired production run ink profile.

A further feature of the invention resides broadly in such a process, characterized by the fact that during the ink feed, the amount of wetting agent is reduced compared to the amount fed during production run.

A yet further feature of the invention resides broadly in such a process, characterized by the fact that the setting of the reverse ink profile is done by means of an electronic computer control apparatus.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A method for establishing a production ink zone profile in an offset printing press, the printing press being for the production of successive prints of an image provided on a printing plate, the successive prints of the image being formed by the deposition of an ink on a printing medium during a printing operation of the offset printing press, the production ink zone profile being established in the printing press prior to the execution of the printing operation of the offset printing press, the printing press including a plate cylinder for receiving the mounting thereon of the printing plate, an ink reservoir for supplying the ink, an ink roller train comprising at least one ink applicator roller for transferring at least a portion of the ink supplied by the reservoir to the printing plate mounted on the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, the ink metering apparatus comprising a plurality of individually adjustable ink metering devices for supplying ink to the ink roller train, said plurality of individually adjustable ink metering devices being disposed sequentially across the printing press in a direction substantially transverse to the direction of travel of the printing medium through the printing press, each of the plurality of individually adjustable ink metering devices defining a corresponding ink zone of the printing press, the amount of ink metered into the corresponding sequentially disposed ink zones defining the ink zone profile of the printing press, said method comprising the steps of:

determining, based upon the image provided on the printing plate, a production ink zone profile appropriate for the printing of the image provided on the printing plate during a production printing run;

determining, for each of the plurality of individually adjustable ink metering devices, a production ink zone flow to produce said production ink zone profile in the printing press during said production printing:

determining an ink flow level within the range of said determined production ink zone flows;

inverting said production ink zone flows about said determined ink flow level to thereby produce an inverted ink zone flow such that:

at least one peak of said production ink zone flow becomes a trough of said inverted ink zone flow: and at least one trough of said production ink zone flow becomes a peak of said inverted ink zone flow;

thereafter, operating the printing press with the plurality of ink metering devices set to produce said inverted ink zone flow;

thereafter, operating the printing press with the plurality of ink metering devices set to produce said production zone ink flow; and thereafter, printing the image provided on the printing plate onto the printing medium.

2. The method for establishing a production ink zone profile in an offset printing press according to claim 1, wherein said step of operating the printing press with the plurality of ink metering devices set to produce said production ink zone flow is conducted so as to simultaneously adapt the sequentially disposed ink zones to said production ink zone profile, independently of the difference between said inverted ink zone flows and said production ink zone flows.

3. The method for establishing a production ink zone profile in an offset printing press according to claim 1, said method additionally comprising the further steps of:

during said step of printing the image provided on the printing plate onto the printing medium, transferring, via the at least one wetting agent applicator roller, a flow of wetting agent from the wetting agent reservoir to the printing plate; and during at least one of said steps of:

operating the printing press with the plurality of ink metering devices set to produce said inverted ink zone flow: and operating the printing press with the plurality of ink metering devices set to produce said production ink zone flow;

transferring, via the at least one wetting agent applicator roller, from the wetting agent reservoir to the printing plate, a flow of wetting agent which is substantially less than said flow of wetting agent transferred therebetween during said step of printing the image provided on the printing plate onto the printing medium.

4. The method for establishing a production ink zone profile in an offset printing press according to claim 2, said method additionally comprising the further steps of:

during said step of printing the image provided on the printing plate onto the printing medium, transferring, via the at least one wetting agent applicator roller, a flow of wetting agent from the wetting agent reservoir to the printing plate; and during at least one of said steps of:

operating the printing press with the plurality of ink metering devices set to produce said inverted ink zone flow: and operating the printing press with the plurality of ink metering devices set to produce said production ink zone flow;

transferring, via the at least one wetting agent applicator roller, from the wetting agent reservoir to the printing plate, flow of wetting agent which is substantially less than said flow of wetting agent transferred therebetween during said step of printing the image provided on the printing plate onto the printing medium.

5. The method for establishing a production ink zone profile in an offset printing press according to claim 1, wherein the printing press further includes a programmable CPU device, and wherein at least one of the following of said steps are carried out by said programmable CPU device:

determining, based upon the image provided on the printing plate, a production ink zone profile appropriate for the printing of the image provided on the printing plate during the production printing run;

determining, for each of the plurality of individually adjustable ink metering devices, a production ink zone flow to produce said production ink zone profile in the printing press during said production printing:

determining an ink flow level within the range of said determined production ink zone flows; and inverting said production ink zone flows about said determined ink flow level to thereby produce an inverted ink zone flow such that peaks of said production ink zone flows become troughs of said inverted ink zone flow, and such that troughs of said production ink zone flows become peaks of said inverted ink zone flow.

6. The method for establishing a production ink zone profile in an offset printing press according to claim 3, wherein the printing press further includes a programmable CPU device, and wherein at least one of the following of said steps are carried out by said programmable CPU device:

determining, based upon the image provided on the printing plate, a production ink zone profile appropriate for the printing of the image provided on the printing plate during the production printing run;

determining, for each of the plurality of individually adjustable ink metering devices, a production ink zone flow to produce said production ink zone profile in the printing press during said production printing;

determining an ink flow level within the range of said determined production ink zone flows; and inverting said production ink zone flows about said determined ink flow level to thereby produce an inverted ink zone flow such that peaks of said production ink zone flows become troughs of said inverted ink zone flow, and such that troughs of said production ink zone flows become peaks of said inverted ink zone flow.

7. The method for establishing a production ink zone profile in an offset printing press according to claim 1, wherein the printing press further includes a programmable CPU device, and wherein at least one of the following said steps are carried out by said programmable CPU device:

determining an ink flow level within the range of said determined production ink zone flows; and inverting said production ink zone flows about said determined ink flow level to thereby produce an inverted ink zone flow, such that peaks of said production ink zone flows become troughs of said inverted ink zone flow, and such that troughs of said production ink zone flows become peaks of said inverted ink zone flow.

8. The method for establishing a production ink zone profile in an offset printing press according to claim 3, wherein the printing press further includes a programmable CPU device, and wherein at least one of the following said steps are carried out by said programmable CPU device:

determining an ink flow level within the range of said determined production ink zone flows; and inverting said production ink zone flows about said determined ink flow level to thereby produce an inverted ink zone flow, such that peaks of said production ink zone flows become troughs of said inverted ink zone flow, and such that troughs of said production ink zone flows become peaks of said inverted ink zone flow.

9. The method for establishing a production ink zone profile in an offset printing press according to claim 1, wherein said determined ink flow level is the arithmetic average of said determined production ink zone flows.

10. The method for establishing a production ink zone profile in an offset printing press according to claim 3, wherein said determined ink flow level is the arithmetic average of said determined production ink zone flows.

11. The method for establishing a production ink zone profile in an offset printing press according to claim 6, wherein said determined ink flow level is the arithmetic average of said determined production ink zone flows.

12. The method for establishing a production ink zone profile in an offset printing press according to claim 8, wherein said determined ink flow level is the arithmetic average of said determined production ink zone flows.

13. A method for establishing a production ink zone profile in an offset printing press, the printing press being for the production of successive prints of an image provided on a printing plate, the successive prints of the image being formed by the deposition of an ink on a printing medium during a printing operation of the offset printing press, the production ink zone profile being established in the printing press prior to the execution of the printing operation of the offset printing press, the printing press including a plate cylinder for receiving the mounting thereon of the printing plate, an ink reservoir for supplying the ink, an ink roller train comprising at least one ink applicator roller for transferring at least a portion of the ink supplied by the reservoir to the printing plate mounted on the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, the ink metering apparatus comprising a plurality of individually adjustable ink metering devices for supplying ink to the ink roller train, said plurality of individually adjustable ink metering devices being disposed sequentially across the printing press in a direction substantially transverse to the direction of travel of the printing medium through the printing press, each of the plurality of individually adjustable ink metering devices defining a corresponding ink zone of the printing press, the amount of ink metered into the corresponding sequentially disposed ink zones defining the ink zone profile of the printing press, said method comprising the steps of:

determining, based upon the image provided on the printing plate, a production ink zone flow from each of the plurality of individually adjustable ink metering devices which produces a production ink zone profile appropriate for the printing of the image provided on the printing plate onto the printing medium;

determining an average production ink zone flow, said average production ink zone flow being the substantial arithmetic average of said production ink zone flows for each of the plurality of individually adjustable ink metering devices;

setting the plurality of individually adjustable ink metering devices to produce initial inverted ink zone flows, said initial inverted ink zone flows being a mirror image of said production ink zone flows, said mirror image being reflected about said average production ink zone flow;

operating the printing press with the plurality of individually adjustable ink metering devices set to produce said initial inverted ink zone flows, and with the at least one ink applicator roller and the at least one wetting agent applicator roller in contact with the printing plate;

setting the plurality of individually adjustable ink metering devices to produce said production ink zone flows;

operating the printing press with the plurality of individually adjustable ink metering devices set to produce said production ink zone flows, and with the at least one ink applicator roller and the at least one wetting agent applicator roller in contact with the printing plate; and printing the image provided on the printing plate onto the printing medium.

14. The method for establishing a production ink zone profile in an offset printing press according to claim 13, wherein said step of operating the printing press with the plurality of ink metering devices set to produce said production ink zone flow is conducted so as to simultaneously adapt the sequentially disposed ink zones to said production ink zone profile, independently of the difference between said inverted ink zone flows and said production ink zone flows.

15. The method for establishing a production ink zone profile in an offset printing press according to claim 13, said method additionally comprising the further steps of:

during said step of printing the image provided on the printing plate onto the printing medium, transferring, via the at least one wetting agent applicator roller, a flow of wetting agent from the wetting agent reservoir to the printing plate; and during at least one of said steps of:

operating the printing press with the plurality of ink metering devices set to produce said inverted ink zone flow; and operating the printing press with the plurality of ink metering devices set to produce said production ink zone flow;

transferring, via the at least one wetting agent applicator roller, from the wetting agent reservoir to the printing plate, flow of wetting agent which is substantially less than said flow of wetting agent transferred therebetween during said step of printing the image provided on the printing plate onto the printing medium.

16. The method for establishing a production ink zone profile in an offset printing press according to claim 15, wherein the printing press further includes a programmable CPU device, and wherein at least one of the following said steps are carried out by said programmable CPU device:

determining the average production ink zone flow; and determining said initial inverted ink zone flows.

17. A method for establishing a production ink zone profile in an offset printing press, the printing press being for the production of successive prints of an image provided on a printing plate, the successive prints of the image being formed by the deposition of an ink on a printing medium during a printing operation of the offset printing press, the production ink zone profile being established in the printing press prior to the execution of the printing operation of the offset printing press, the printing press including a plate cylinder for receiving the mounting thereon of the printing plate, an ink reservoir for supplying the ink, an ink roller train comprising at least one ink applicator roller for transferring at least a portion of the ink supplied 'y the reservoir to the printing plate mounted on the plate cylinder, an ink metering apparatus for metering ink from the ink reservoir to the ink roller train, a wetting agent reservoir for supplying a wetting agent, and a wetting roller train comprising at least one wetting agent applicator roller for transferring at least a portion of the wetting agent supplied by the wetting agent reservoir to the printing plate mounted upon the printing cylinder, the ink metering apparatus comprising a plurality of individually adjustable ink metering devices for supplying ink to the ink roller train, said plurality of individually adjustable ink metering devices being disposed sequentially across the printing press in a direction substantially transverse to the direction of travel of the printing medium through the printing press, each of the plurality of individually adjustable ink metering devices defining a corresponding ink zone of the printing press, the amount of ink metered into the corresponding sequentially disposed ink zones defining the ink zone profile of the printing press, said method comprising the steps of:

determining an appropriate ink zone profile for the printing of the image provided on the printing plate;

determining, for each of the plurality of ink zones, an appropriate flow of ink from the corresponding ink metering device to produce said appropriate ink zone profile for the image provided on the printing plate;

determining an average ink flow of said appropriate flows of ink;

determining, for at least one of said ink zones, a corresponding signed difference between said corresponding appropriate ink zone flow and said average ink flow:

initially, setting said corresponding at least one ink metering device to an initial flow, a setting which differs from said average ink flow by said corresponding signed difference multiplied by $-1$;

thereafter, operating the printing press with the at least one ink metering device set to said initial flow setting:

thereafter, setting said corresponding at least one ink metering device to said appropriate ink zone flow;

thereafter, operating the printing press with the at least one ink metering device set to said appropriate ink zone flow;

thereafter, printing the image provided on the printing plate onto the printing medium.

18. The method for establishing a production ink zone profile in an offset printing press according to claim 17, wherein said step of operating the printing press with the at least one ink metering device set to said initial flow setting is conducted so as to simultaneously adapt the sequentially disposed ink zones to said production ink zone profile, independently of the difference between said initial flow setting and said appropriate ink zone flow.

19. The method for establishing a production ink zone profile in an offset printing press according to claim 17, said method additionally comprising the further steps of:

during said step of printing the image provided on the printing plate onto the printing medium, transferring, via the at least one wetting agent applicator roller, a flow of wetting agent from the wetting agent reservoir to the printing plate; and during at least one of said steps of:

operating the printing press with the at least one ink metering device set to said initial flow setting: and operating the printing press with the at least one metering device set to said appropriate ink zone flow:

transferring, via the at least one wetting agent applicator roller, from the wetting agent reservoir to the printing plate, flow of wetting agent which is substantially less than said flow of wetting agent transferred therebetween during said step of printing the image provided on the printing plate onto the printing medium.

20. The method for establishing a production ink zone profile in an offset printing press according to claim 19, wherein the printing press further includes a programmable CPU device, and wherein at least one of the following of said steps are carried out by said programmable CPU device:

determining said average ink flow; and determining, for at least one of said ink zones, a corresponding signed difference between said corresponding appropriate ink zone flow and said average ink flow.

* * * * *

UNITED STATES PATENT AND TRADEMARK OFFICE

CERTIFICATE OF CORRECTION

PATENT NO. : 5,148,747

DATED : September 22, 1992

INVENTOR(S) : Anton RODI, Bernd MÜLLER and Robert MÜLLER

It is certified that error appears in the above-identified patent and that said Letters Patent is hereby corrected as shown below:

In column 14, line 37, after 'printing', delete "Job" and insert --job--.

In column 15, line 17, after 'cylinder', delete "0" and insert --40--.

In column 21, line 66, Claim 17, after 'supplied', delete " 'y " and insert --by--.

Signed and Sealed this

Fifth Day of April, 1994

Bruce Lehman

*Attest:*

BRUCE LEHMAN

*Attesting Officer*

*Commissioner of Patents and Trademarks*